US011905790B2

(12) United States Patent
Chouzenoux et al.

(10) Patent No.: US 11,905,790 B2
(45) Date of Patent: Feb. 20, 2024

(54) SAFETY VALVE WITH ELECTRICAL ACTUATORS

(71) Applicant: Schlumberger Technology Corporation, Sugar Land, TX (US)

(72) Inventors: Christian Chouzenoux, Clamart (FR); Cash Elston, Taubate (BR); Olivier Loeuillet, Clamart (FR); Francesco Vaghi, Houston, TX (US); Oguzhan Guven, Bellaire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/904,740

(22) PCT Filed: Feb. 24, 2021

(86) PCT No.: PCT/US2021/019432
§ 371 (c)(1),
(2) Date: Aug. 22, 2022

(87) PCT Pub. No.: WO2021/173684
PCT Pub. Date: Sep. 2, 2021

(65) Prior Publication Data

US 2023/0018892 A1 Jan. 19, 2023

Related U.S. Application Data

(60) Provisional application No. 63/147,018, filed on Feb. 8, 2021, provisional application No. 62/980,931, filed on Feb. 24, 2020.

(51) Int. Cl.
*E21B 34/06* (2006.01)

(52) U.S. Cl.
CPC ..... *E21B 34/066* (2013.01); *E21B 2200/05* (2020.05)

(58) Field of Classification Search
CPC ..... E21B 34/066
See application file for complete search history.

(56) References Cited

U.S. PATENT DOCUMENTS 5,070,944 A 12/1991 Hopper
6,269,874 B1 * 8/2001 Rawson ..... E21B 34/066 166/332.6

(Continued)

FOREIGN PATENT DOCUMENTS

CN 110295873 A 10/2019
EP 1236862 A2 9/2002

(Continued)

OTHER PUBLICATIONS

International Search Report and Written Opinion of PCT Application No. PCT/US2021/019432 dated Jun. 14, 2021, 9 pages.

(Continued)

*Primary Examiner* — Jennifer H Gay
(74) *Attorney, Agent, or Firm* — Jeffrey D. Frantz

(57) ABSTRACT

A downhole valve assembly includes a safety valve and an actuator that opens and/or closes the valve. The actuator can be an electro-hydraulic actuator (EHA), an electro mechanical actuator (EMA), or an electro hydraulic pump (EHP). The downhole safety valve can also include an electric magnet.

20 Claims, 20 Drawing Sheets

(56) References Cited

U.S. PATENT DOCUMENTS 6,433,991 B1 8/2002 Deaton et al.
6,619,388 B2 * 9/2003 Dietz ..... E21B 34/066 166/66
7,434,626 B2 10/2008 Vick, Jr.
7,481,283 B2 1/2009 McDonald et al.
7,487,829 B2 2/2009 McDonald et al.
7,549,467 B2 6/2009 McDonald et al.
7,640,989 B2 * 1/2010 Williamson, Jr. .... E21B 34/066 166/66.5
7,967,074 B2 * 6/2011 Lake ..... E21B 34/066 251/30.01
8,038,120 B2 10/2011 Vick, Jr. et al.
8,176,975 B2 5/2012 Lake et al.
8,191,634 B2 6/2012 Xu
8,210,258 B2 7/2012 OMalley et al.
8,267,167 B2 * 9/2012 Lake ..... E21B 34/066 166/66.5
8,353,353 B2 1/2013 Reaux
8,376,040 B2 2/2013 Birkeland et al.
8,393,386 B2 * 3/2013 Lake ..... F16K 31/082 166/66.5
8,453,748 B2 * 6/2013 Vick, Jr. ..... E21B 34/10 166/321
8,464,799 B2 * 6/2013 Scott ..... E21B 34/16 166/373
8,490,687 B2 7/2013 Scott et al.
8,573,304 B2 * 11/2013 Vick, Jr. ..... E21B 34/066 166/334.1
8,662,187 B2 * 3/2014 Lake ..... E21B 34/066 335/282
8,857,522 B2 10/2014 Arrazola et al.
8,869,881 B2 10/2014 Vick, Jr. et al.
8,919,730 B2 12/2014 Vick, Jr.
9,163,479 B2 10/2015 Rogers et al.
9,556,707 B2 1/2017 Vick, Jr. et al.
9,695,646 B2 7/2017 Grice
9,909,387 B2 3/2018 Scott et al.
10,174,589 B2 * 1/2019 Vick, Jr. ..... F16K 31/1221
10,355,334 B2 7/2019 Bokenfohr et al.
10,480,283 B2 11/2019 Joseph et al.
10,655,431 B2 5/2020 Gonzalez et al.
10,670,160 B2 * 6/2020 Phelps ..... E21B 34/066
10,724,332 B2 * 7/2020 Henschel, Jr. ..... E21B 34/066
10,982,506 B2 4/2021 Eriksen
10,989,019 B2 4/2021 Cai et al.
11,035,199 B2 * 6/2021 Vick, Jr. ..... E21B 34/066
11,168,540 B2 11/2021 Ng et al.
11,180,974 B2 11/2021 Vick, Jr. et al.
11,248,441 B2 2/2022 Vick, Jr. et al.
11,248,718 B2 2/2022 Lake
11,274,526 B2 * 3/2022 Deville ..... E21B 34/14
11,319,773 B2 * 5/2022 Candido Gomes ..... E21B 43/12
2002/0108747 A1 * 8/2002 Dietz ..... E21B 34/066 166/66.4
2007/0034385 A1 * 2/2007 Tips ..... E21B 21/103 166/66.6
2008/0053662 A1 * 3/2008 Williamson ..... E21B 34/066 166/381
2008/0157014 A1 * 7/2008 Vick, Jr. ..... F16K 31/086 251/65
2009/0151790 A1 6/2009 Ranjan et al.
2010/0025045 A1 * 2/2010 Lake ..... E21B 34/066 166/373
2011/0037004 A1 * 2/2011 Lake ..... E21B 34/066 251/129.01
2011/0120727 A1 * 5/2011 Lake ..... F16K 31/082 166/66.7
2011/0120728 A1 * 5/2011 Lake ..... E21B 34/066 137/1
2011/0155381 A1 6/2011 Reaux
2011/0186303 A1 * 8/2011 Scott ..... E21B 34/08 166/373
2011/0240299 A1 * 10/2011 Vick, Jr. ..... E21B 34/10 137/511
2012/0125597 A1 * 5/2012 Vick, Jr. ..... E21B 34/066 166/321
2013/0032355 A1 2/2013 Scott et al.
2013/0181719 A1 * 7/2013 Wilson ..... E21B 4/00 324/346
2013/0341034 A1 12/2013 Biddick et al.
2016/0265309 A1 * 9/2016 Vick, Jr. ..... F16K 31/1221
2017/0002945 A1 * 1/2017 Phelps ..... E21B 34/066
2019/0203564 A1 * 7/2019 Henschel, Jr. ..... E21B 34/066
2020/0095843 A1 3/2020 Vick, Jr. et al.
2020/0166026 A1 5/2020 Marica
2020/0270965 A1 * 8/2020 Vick, Jr. ..... F16K 31/0655
2020/0392812 A1 * 12/2020 Vick, Jr. ..... F04C 15/066
2021/0215020 A1 * 7/2021 Deville ..... E21B 23/04
2021/0324708 A1 * 10/2021 Candido Gomes ... E21B 34/066
2023/0018892 A1 * 1/2023 Chouzenoux ..... E21B 34/066
2023/0151714 A1 * 5/2023 Garsault ..... E21B 47/12 166/373

FOREIGN PATENT DOCUMENTS

GB 2433523 A 6/2007
RU 2736742 C1 11/2020
WO 2011005826 A1 1/2011
WO 2011094084 A2 8/2011
WO 2015094168 A1 6/2015
WO 2017027009 A1 2/2017
WO 2017204654 A1 11/2017
WO 2017204804 A1 11/2017
WO 2019089487 A1 5/2019
WO WO-2019089487 A1 * 5/2019 ..... E21B 23/04
WO 2020041056 A1 2/2020
WO 2021048225 A1 3/2021
WO 2022000062 A1 1/2022

OTHER PUBLICATIONS

International Search Report and Written Opinion of PCT Application No. PCT/US2022/020325 dated Jul. 7, 2022, 11 pages.

* cited by examiner

SAFETY VALVE WITH ELECTRICAL ACTUATORS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage of International Application No. PCT/US2021/019432, filed Feb. 24, 2021, which claims priority benefit of U.S. Provisional Application No. 62/980,931, filed Feb. 24, 2020, and U.S. Provisional Application No. 63/147,018, filed Feb. 8, 2021, the entirety of each of which is incorporated by reference herein and should be considered part of this specification.

BACKGROUND

Field

The present disclosure generally relates to safety valves, and more particularly to safety valves having electrical actuators and fully electric safety valves.

Description of the Related Art

Valves typically are used in a well for such purposes as fluid flow control, formation isolation, and safety functions. A common downhole valve is a hydraulically-operated valve, which is known for its reliable performance. However, hydraulically-operated valves have limitations.

For example, the use of a hydraulically-operated valve is depth-limited due to the high hydrostatic pressure acting against the valve at large depths, which may diminish the effective hydraulic pressure that is available to operate the valve. Furthermore, for deep applications, the viscous control fluid in a long hydraulic line may cause unacceptably long operating times for certain applications. In addition, a long hydraulic line and the associated connections provide little or no mechanism to determine, at the surface of the well, what is the true state of the valve. For example, if the valve is a safety valve, there may be no way to determine the on-off position of the valve, the pressure across the valve and the true operating pressure at the valve's operator at the installed depth.

SUMMARY

In some configurations, a downhole valve assembly includes an electric safety valve and an actuator configured to open and/or close the valve. The actuator can be an electro hydraulic actuator, an electro mechanical actuator, or an electro hydraulic pump. In some configurations, the electric safety valve is fully electric and does not include any hydraulic components.

The electric safety valve can include a flapper, a return spring, and an internal tubing sleeve. In use, the actuator can be configured to extend to move the internal tubing sleeve from a closed position to an open position, thereby compressing the return spring and opening the flapper. The electric safety valve can further include downhole electronics configured to receive a signal from the surface and control the actuator.

The electric safety valve can include an electric magnet. The electric magnet can be configured to magnetically couple to a corresponding magnet disposed in or on a flange of the internal tubing sleeve, the flange configured to compress the return spring when the electric safety valve is in the open position. Alternatively, the electric magnet can be disposed in, on, or adjacent a movable shaft of the actuator and configured to magnetically couple to a corresponding magnet disposed in a wall of the internal tubing sleeve.

In some configurations, the electric magnet can be configured to be activated when the electric safety valve is in an open position, thereby allowing the actuator to be retracted while holding the internal tubing sleeve and flapper in the open position. In some configurations, the electric magnet is configured to be activated prior to extending the actuator and opening the electric safety valve, and during closure, the internal tubing sleeve is retracted prior to retraction of the actuator. Closing of the electric safety valve can be controlled by the electric magnet. The electric safety valve can be moved to a closed position by deactivating the electric magnet.

In some configurations, a method of operating an electric downhole safety valve, the electric downhole safety valve comprising a flapper, an internal tubing sleeve, a return spring, an actuator, and downhole electronics, can include providing a command from the surface to the downhole electronics; in response to the command from the surface, extending the actuator, thereby shifting the internal tubing sleeve from a closed position to an open position; compressing the return spring; and opening the flapper.

The actuator can be an electro-mechanical actuator. The electric downhole safety valve can include an electric magnet. The method can further include activating the electric magnet.

The method can include retracting the actuator while the internal tubing sleeve is held in the open position by the electric magnet. The method can include deactivating the electric magnet. Deactivating the electric magnet can allow the return spring to expand, thereby shifting the internal tubing sleeve to the closed position and allowing the flapper to close.

The method can include activating the electric magnet prior to extending the actuator. The method can further include deactivating the electric magnet, allowing the return spring to expand, thereby shifting the internal tubing sleeve to the closed position, and allowing the flapper to close, while the actuator is extended; and retracting the actuator after the flapper is closed.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1A:
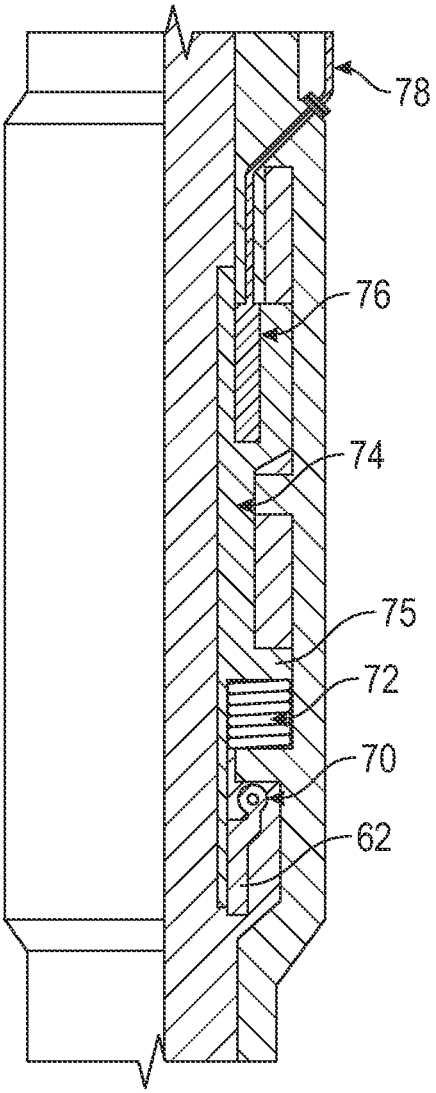
FIG. 1A illustrates an example conventional downhole safety valve in an open position.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Well completions often include various valves, such as safety valves and flow control valves. Downhole or subsurface safety valves are often deployed in an upper part of a well completion to provide a barrier against uncontrolled flow below the valve. The valve must be able to operate in a failsafe mode to close and stop well production in case of an emergency. Typically such valves have been hydraulically operated. However, hydraulically operated valves have limitations. For example, the use of a hydraulically-operated valve is depth-limited due to the high hydrostatic pressure acting against the valve at large depths, which may diminish the effective hydraulic pressure that is available to operate the valve. Furthermore, for deep applications, the viscous control fluid in a long hydraulic line may cause unacceptably long operating times for certain applications. In addition, a long hydraulic line and the associated connections provide little or no mechanism to determine, at the surface of the well, what is the true state of the valve. For example, if the valve is a safety valve, there may be no way to determine the on-off position of the valve, the pressure across the valve and the true operating pressure at the valve's operator at the installed depth.

Compared to hydraulic completion systems, electric completion systems can provide reduced capital expenditures, reduced operating expenditures, and reduced health, safety, and environmental problems. Electric completions can advantageously allow for the use of sensors and proactive decision making for well control.

The present disclosure provides electric safety valves, systems (e.g., well completions) including such electric safety valves, and methods of operating electric safety valves. In some configurations, an inductive coupler is used with an electric safety valve or completion including an electric safety valve. The safety valves can have a flapper valve design. The present disclosure also provides an electro-magnet disconnect system. The disconnect system enables a safe and reliable closing mechanism capable of withstanding extreme slam shutting.

Figure 1B:
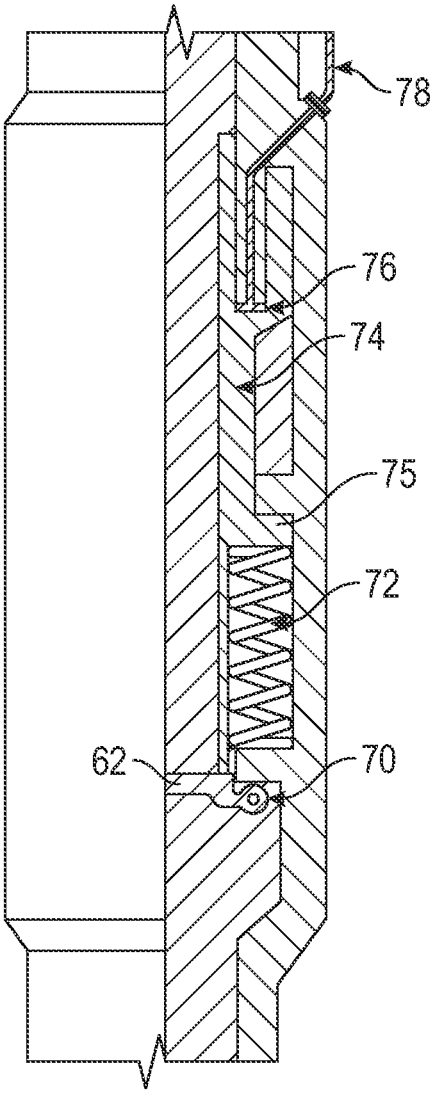
FIG. 1B illustrates the safety valve of FIG. 1A in a closed position.

Conventional downhole safety valves are typically operated via a hydraulic connection to or from a surface panel. FIGS. 1A and 1B illustrate an example hydraulic safety valve having a flapper valve design in open and closed positions, respectively. As shown, the safety valve assembly includes a flapper 62, a return spring 72, a flow tube or sleeve 74, a piston 76, and a control line 78. The position (open or closed) of the flapper 62 is controlled via the flow tube or sleeve 74 sliding up and down inside the production tubing. The sleeve position is controlled or moved by the return spring 72 and/or the piston 76. The flapper 62 and return spring 72 are biased to the closed position.

Hydraulic pressure applied from the surface via the control line 78 to the piston 76 causes the piston 76 to move the sleeve 74 downward, thereby compressing the return spring 72, and open the flapper 62. In the illustrated configuration, the sleeve 74 includes a radially outwardly projecting flange 75 that contacts and compresses the spring 72. Hydraulic pressure in the piston 76 maintains the sleeve's position and holds the valve open. As shown, at least a portion of the flapper 62 is shielded from flow through the production tubing by a portion of the sleeve 74, so the sleeve 74 protects the flapper 62 and tubing sealing area from flow erosion. If the hydraulic pressure in the control line 78 is released, whether intentionally or unintentionally, the spring 72 bias pushes the sleeve 74 upward, allowing the flapper 62 to close. The spring 72 and/or flapper 62 bias to the closed position provides a failsafe for the valve, as the spring 72 ensures valve closure in case of emergency, such as a catastrophic event on the surface leading to a pressure drop or loss in the hydraulic control line 78.

Figure 2:
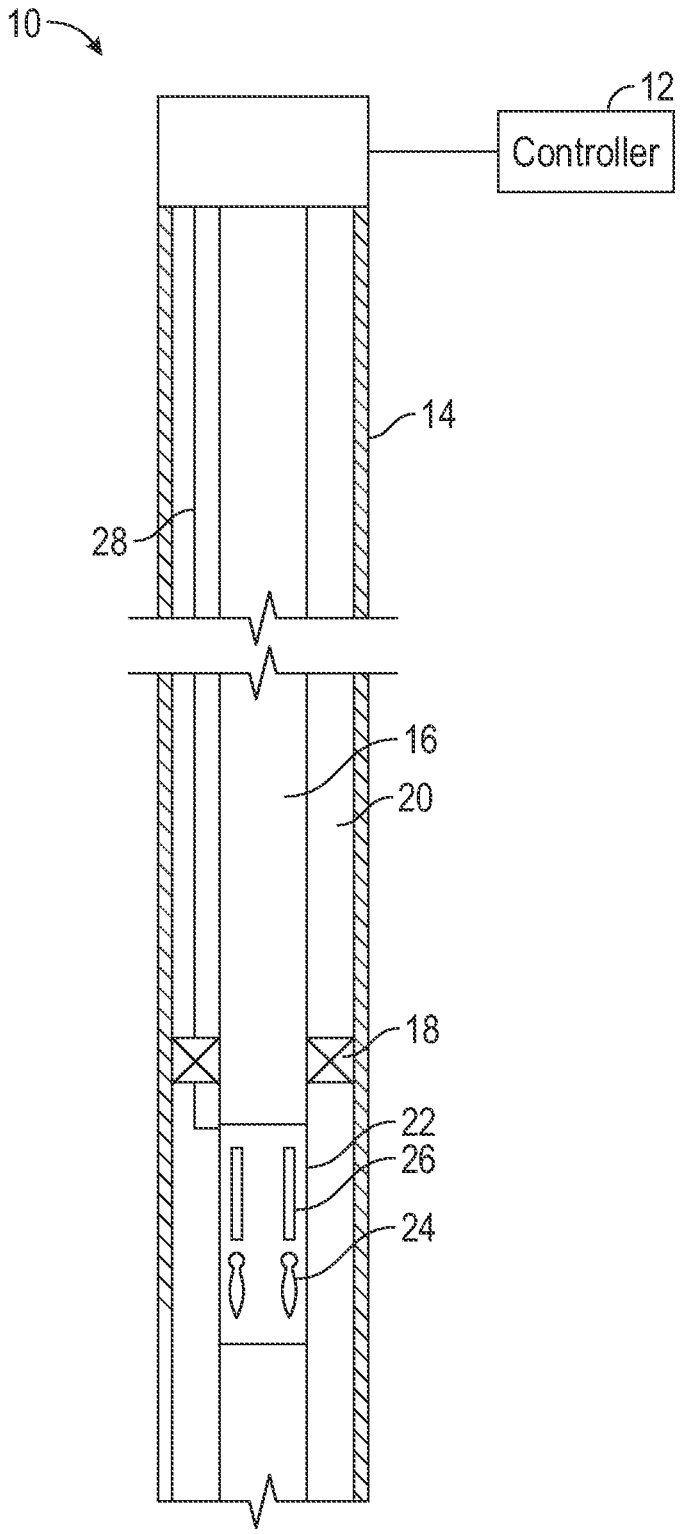
FIG. 2 illustrates an embodiment of a completion string having a subsurface safety valve in a wellbore.

FIG. 2 illustrates an example completion string including a safety valve according to the present disclosure positioned in a wellbore 10. The wellbore 10 may be part of a vertical well, deviated well, horizontal well, or a multilateral well. The wellbore 10 may be lined with casing 14 (or other suitable liner) and may include a production tubing 16 (or other type of pipe or tubing) that runs from the surface to a hydrocarbon-bearing formation downhole. A production packer 18 may be employed to isolate an annulus region 20 between the production tubing 16 and the casing 14.

A subsurface safety valve assembly 22 may be attached to the tubing 20. The subsurface safety valve assembly 22 may include a flapper valve 24 or some other type of valve (e.g., a ball valve, sleeve valve, disk valve, and so forth). The flapper valve 24 is actuated opened or closed by an actuator assembly 26. During normal operation, the valve 24 is actuated to an open position to allow fluid flow in the bore of the production tubing 16. The safety valve 24 is designed to close should some failure condition be present in the wellbore 10 to prevent further damage to the well.

The actuator assembly 26 in the safety valve assembly 22 may be electrically activated by signals provided by a controller 12 at the surface to the actuator assembly 26 via an electrical cable 28. The controller 12 is therefore operatively connected to the actuator assembly 26 via the cable 28. Other types of signals and/or mechanisms for remote actuation of the actuator assembly 26 are also possible. Depending on the application, the controller 12 may be in the form of a computer-based control system, e.g. a microprocessor-based control system, a programmable logic control system, or another suitable control system for providing desired control signals to and/or from the actuator assembly 26. The control signals may be in the form of electric power and/or data signals delivered downhole to subsurface safety valve assembly 22 and/or uphole from subsurface safety valve assembly 22.

Figure 3:
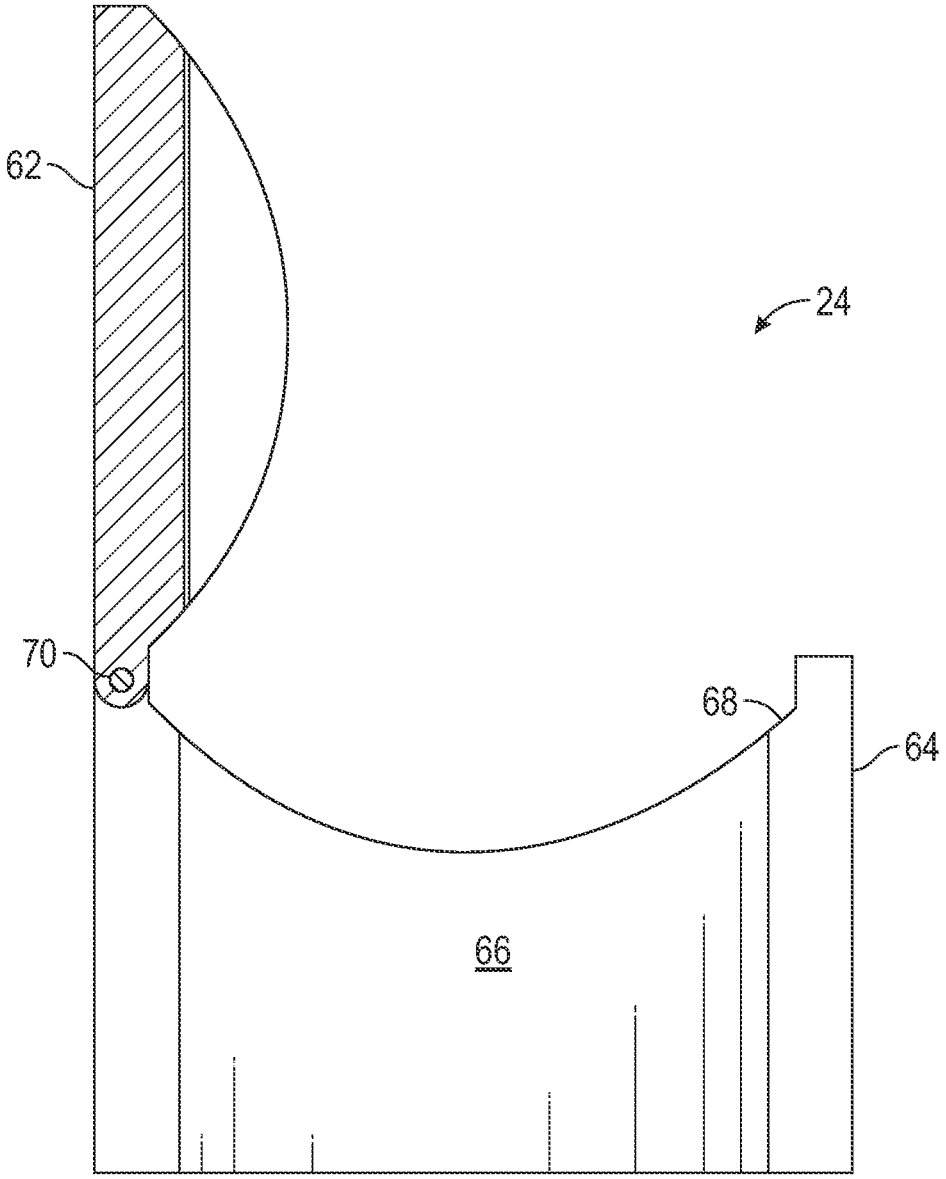
FIG. 3 is a cross-sectional illustration of an example of a flapper valve which may be utilized in a downhole system.

FIG. 3 illustrates an example flapper valve 24. In this embodiment, the flapper 62 is pivotably mounted along a flapper housing 64 having an internal passage 66 therethrough and having a hard sealing surface 68. The flapper 62 is pivotably coupled to the flapper housing 64, for example, via a hinge pin 70, for movement between an open position and a closed position. By pivotably coupled, it should be understood the flapper 62 may be directly coupled to housing 64 or indirectly coupled to the housing 64 via an intermediate member.

Additional details regarding safety valves can be found in, for example, U.S. Pat. No. 6,433,991 and WO 2019/089487, the entirety of each of which is hereby incorporated by reference herein. Although the present disclosure describes an actuator used with a subsurface safety valve, it is contemplated that further embodiments may include actuators used with other types of downhole devices. Such other types of downhole devices may include, as examples, flow control valves, packers, sensors, pumps, and so forth. Other embodiments may include actuators used with devices outside the well environment.

The actuator assembly 26 can be or include various types of actuators, such as electrical actuators. For example, in some configurations, the actuator assembly 26 is or includes an electro hydraulic actuator (EHA), an electro mechanical actuator (EMA), or an electro hydraulic pump (EHP). An EHA can allow for quick backdrive or actuation and therefore quick close functionality, which advantageously allows for rapid closure of the valve 24 when desired or required.

In some configurations, the actuator assembly 26 is fully electric and the safety valve assembly 22 is fully electric. In other words, the safety valve assembly 22 includes no hydraulic components. In some such configurations, the actuator assembly 26 is or includes an EMA.

Figure 4:
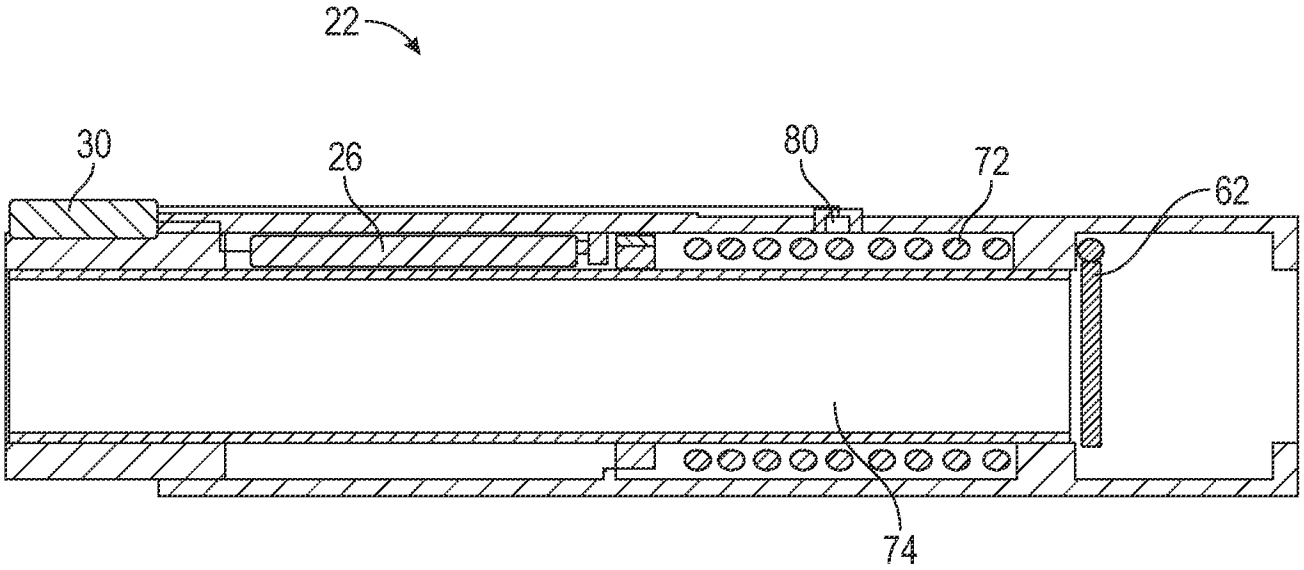
FIG. 4 schematically shows a longitudinal cross-section of an example downhole safety valve including a downhole electro-mechanical actuator and electro-magnet.
Figure 8:
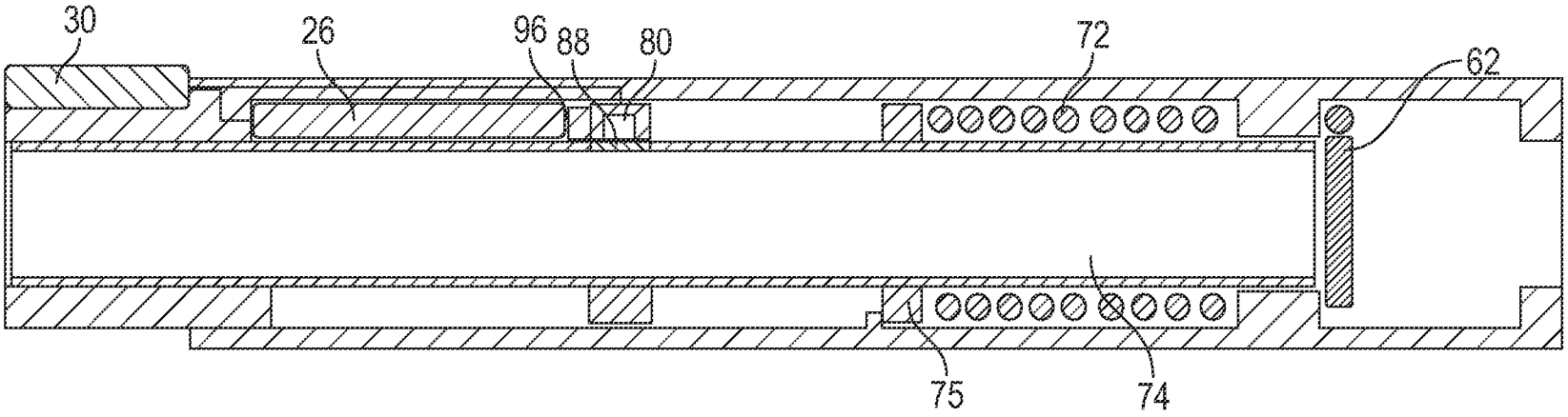
FIG. 8 schematically shows a longitudinal cross-section of another example downhole safety valve including a downhole electro-mechanical actuator and electro-magnet.

In some configurations, the present disclosure advantageously provides a downhole electro-mechanical actuator in combination with an electrical magnet to control a valve, such as a downhole safety valve 22, for example as shown in FIGS. 4 and 8. The safety valve can include various features of the configurations shown in FIGS. 1-3. However, compared to the example valve of FIGS. 1A-1B, the safety valves of FIGS. 4 and 8 include, and their position is controlled by, an electric actuator 26 rather than hydraulic pressure applied via a control line from the surface. The actuator 26 is controlled and powered by a downhole electronics cartridge 30. The downhole electronics 30 can be connected to the surface via an electrical cable, for example, cable 28 (shown in FIG. 2). In a closed mode or position of the safety valve, the actuator 26 is fully retracted such that the return spring 72 is fully expanded, and the flapper 62 is closed.

Figure 5:
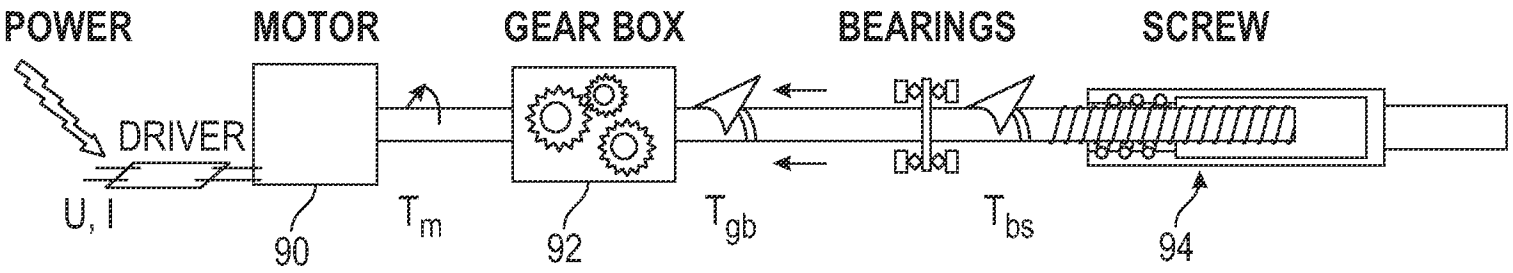
FIG. 5 schematically illustrates the principle of a linear electro-mechanical actuator that can be included in valves such as the valve of FIG. 4.

FIG. 5 schematically illustrates the principle of a linear electro-mechanical actuator, for example as may be included in valve assemblies according to the present disclosure, such as the valve assemblies of FIGS. 4 and 8. As shown, an electrical motor 90 is powered and controlled by embedded downhole electronics 30. Motor rotation is converted into linear motion via a gear box 92 and screw mechanical assembly 94. In use, the motor 90 is activated by a surface command received and interpreted by the downhole electronics 30. The required linear force is obtained by the torque applied by the motor 90 at gear box entry.

Figure 6:
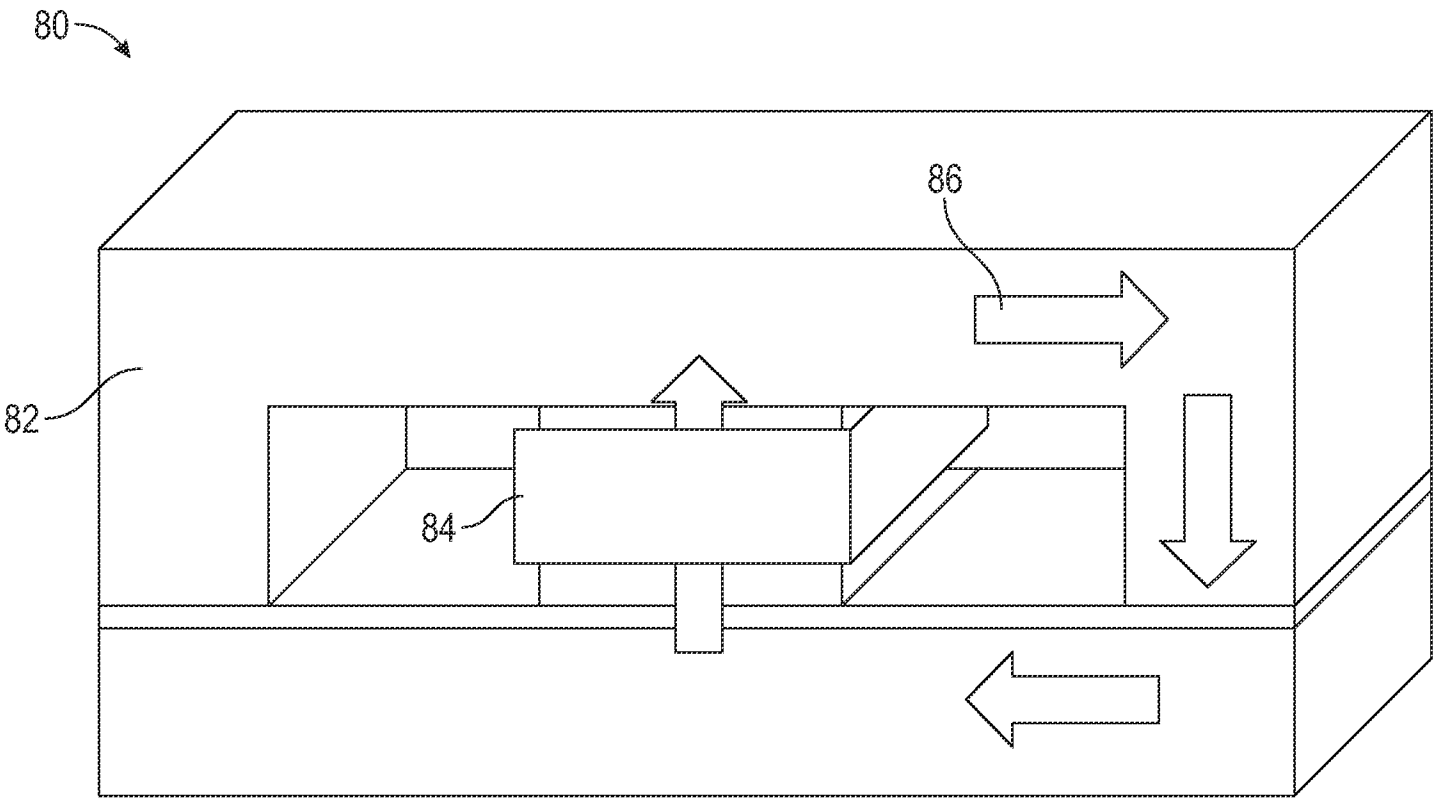
FIG. 6 schematically illustrates the principle of an electrical magnet that can be included in valves such as the valve of FIG. 4.

FIG. 6 schematically illustrates the principle of an electrical magnet 80, for example as may be included in valve assemblies according to the present disclosure, such as the valve assemblies of FIGS. 4 and 8. As shown, the electrical magnet, or e-magnet 80, includes a magnetic core 82. The core 82 includes a coil of wires 84 having an appropriate number of turns to induce a required magnetic field when the coil 84 is powered on with a DC current. The magnetic field B (indicated by arrows 86 in FIG. 6) creates a force F inside each section area A of the core assembly according to the equation:

$$F = \frac{B^2 A}{2\mu_0}$$

A force up to 40N can be induced by a magnetic field of 1 Tesla per $cm^2$. As core materials commonly used are known to saturate above 1.3 Tesla, a force up to 1000 N can be achieved with a core section in the order of 15 $cm^2$.

Figure 7A:
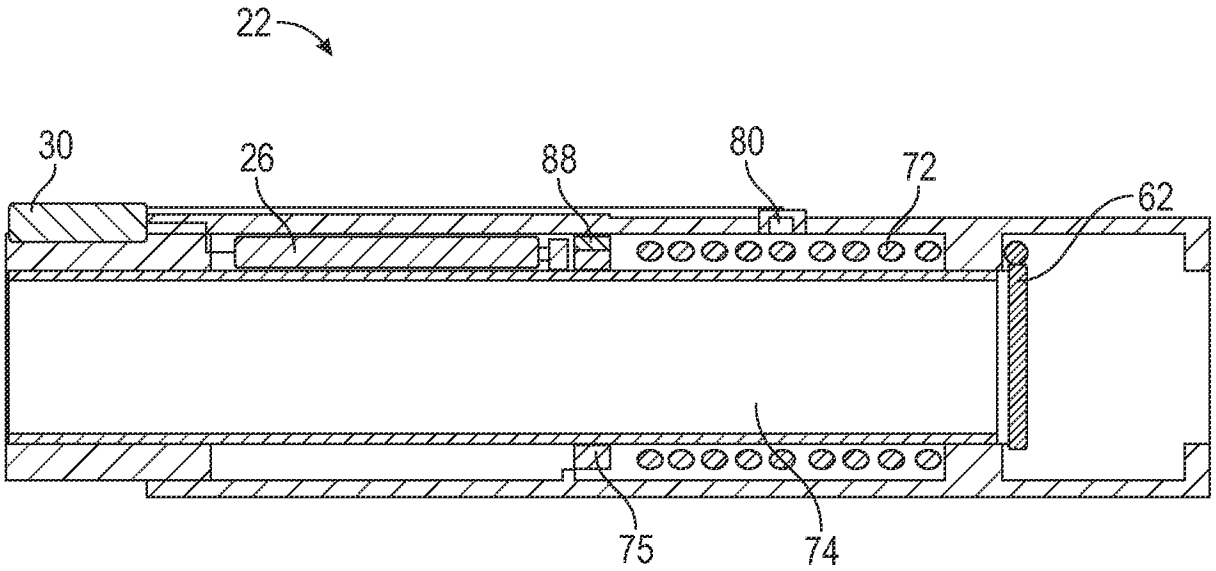
FIGS. 7A-7F schematically illustrate operation of the safety valve of FIG. 4.
Figure 7B:
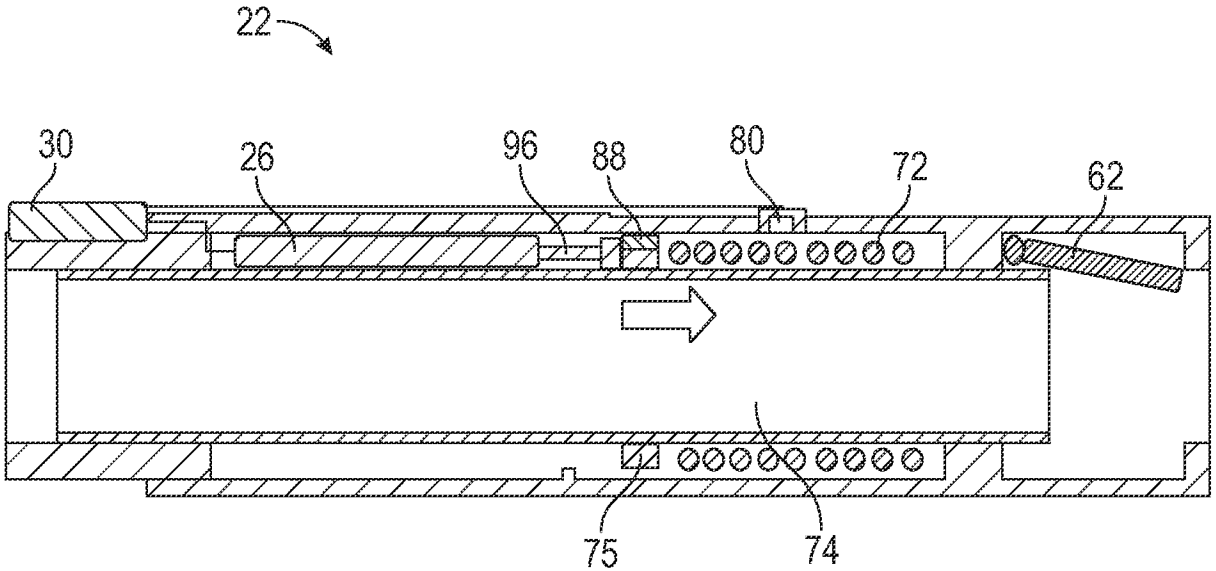
Figure 7C:
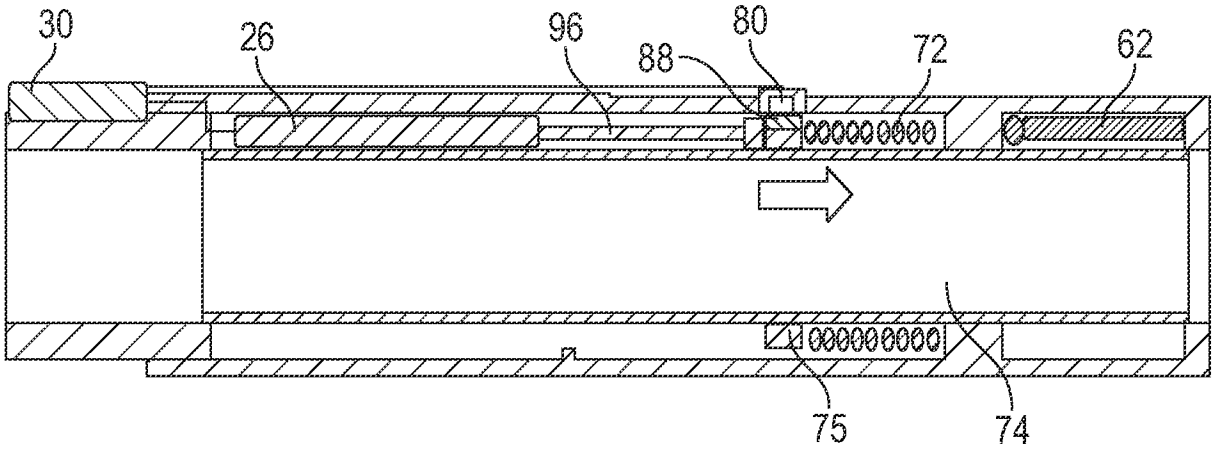

FIGS. 7A-7F schematically illustrate operation of safety valves according to the present disclosure, such as the valve 22 of FIG. 4. FIG. 7A shows the valve 22 in a closed position, with the electro-mechanical actuator (EMA) 26 in a fully retracted position and the E-magnet 80 not activated. FIG. 7B shows the valve opening in response to a command from the surface to the downhole electronics 30. As shown, the EMA 26 is extending, and the E-magnet 80 is still not activated. Extension of the EMA 26 (e.g., a piston 96 of or coupled to the EMA 26) compresses the return spring 72. Extension of the EMA 26 (e.g., a piston 96 of or coupled to the EMA) moves the internal tubing sleeve 74 toward, into contact with, and/or past the flapper 62 to open the flapper 62. In FIG. 7C, the valve is fully opened, the EMA 26 is in the fully expanded position (and the return spring 72 can be fully compressed and/or the internal tubing sleeve 74 can be shifted to hold open and protect the flapper 62), and the E-magnet 80 is not yet activated.

Figure 7D:
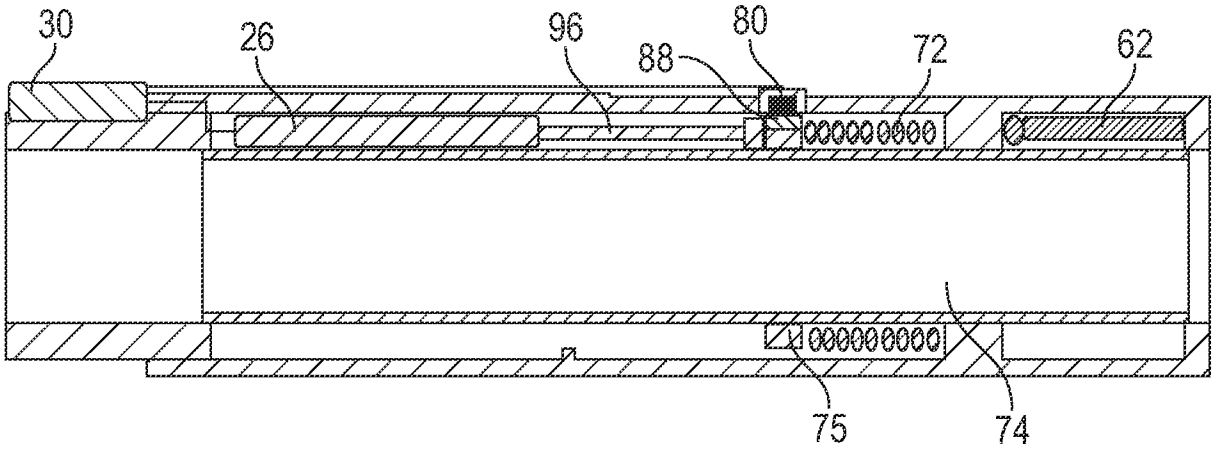

FIG. 7D shows the valve fully opened, the EMA 26 fully extended, and the E-magnet 80 activated. In some configurations, the E-magnet 80 is configured to interact with, e.g., magnetically interact or couple with, a corresponding magnet or magnetic component 88 when activated. In the illustrated configuration, the magnet or magnetic component 88 is disposed in or on the flange 75 of the internal sleeve 74. As the EMA 26, or piston or shaft 96 thereof, extends, the EMA 26 (or piston or shaft 96) axially displaces the flange 75, thereby compressing the spring 72. When the spring is fully compressed 72 and the valve is fully open, the magnet or magnetic component 88 is aligned with (e.g., radially aligned with and/or at generally or about the same axial depth as) the E-magnet 80, as shown in FIGS. 7C-7D.

Figure 7E:
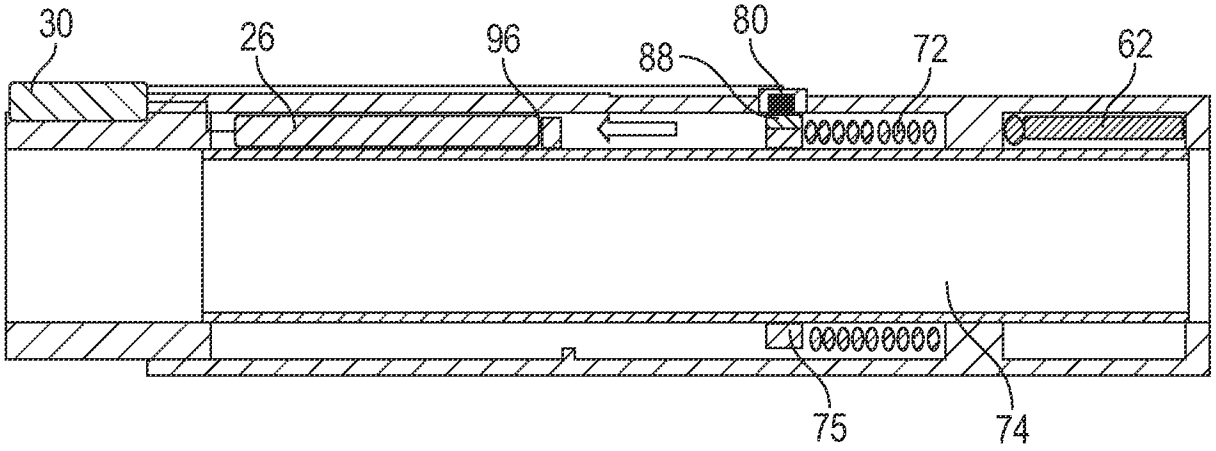
Figure 7F:
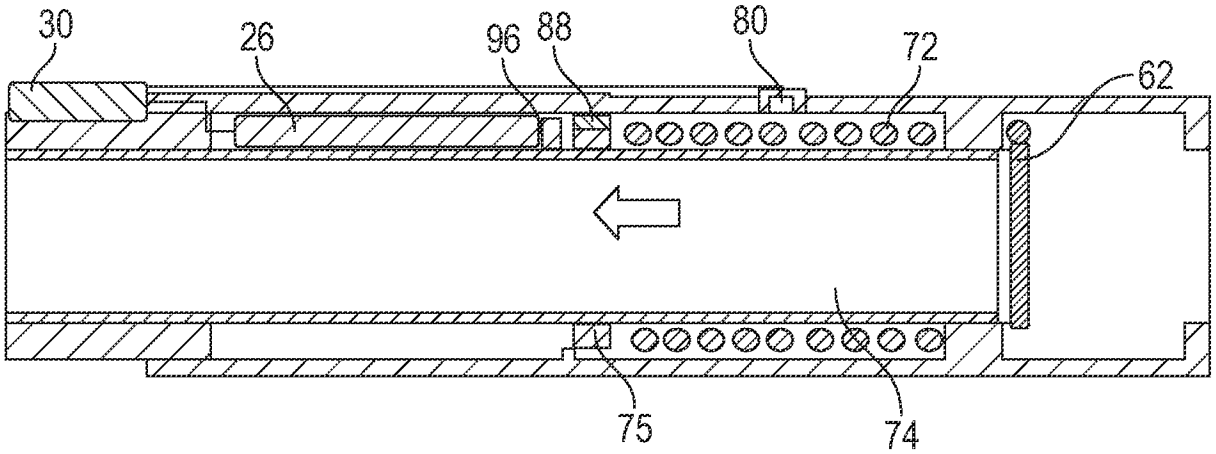

Activation of the E-magnet 80 can hold the internal tubing sleeve 74 in its shifted position (e.g., the position holding open and protecting the flapper 62, for example as shown in FIGS. 7C-7D) via magnetic coupling between the E-magnet 80 and magnet or magnetic component 88. FIG. 7E shows the EMA 26 (e.g., the piston or shaft 96) retracted, with the E-magnet 80 still activated, thereby maintaining the internal tubing 74 in its shifted position and the valve in a fully open position. FIG. 7F shows the EMA 26 retracted and the E-magnet 80 de-activated. With the EMA retracted, de-activation of the E-magnet 80 allows the return spring 72 to expand and bias the internal sleeve 74 back to its original, closed position, allowing the flapper 62 to close such that the valve 22 is in a fully closed position or state.

FIG. 8 illustrates another example electric safety valve 22 including an EMA 26 and an E-magnet 80. In the configuration of FIG. 8, the E-magnet 80 is included in, on, or adjacent the piston or shaft 96 of the actuator 26. The E-magnet 80 is therefore in-line (e.g., axially aligned with or aligned along a common axis parallel to a longitudinal axis extending through the bore of the internal tubing sleeve 74) with the actuator 26, or piston or shaft 96 of the actuator 26. In the illustrated configuration, the corresponding magnet or magnetic component 88 is disposed within the body or wall of the internal tubing sleeve 74.

Figure 9A:
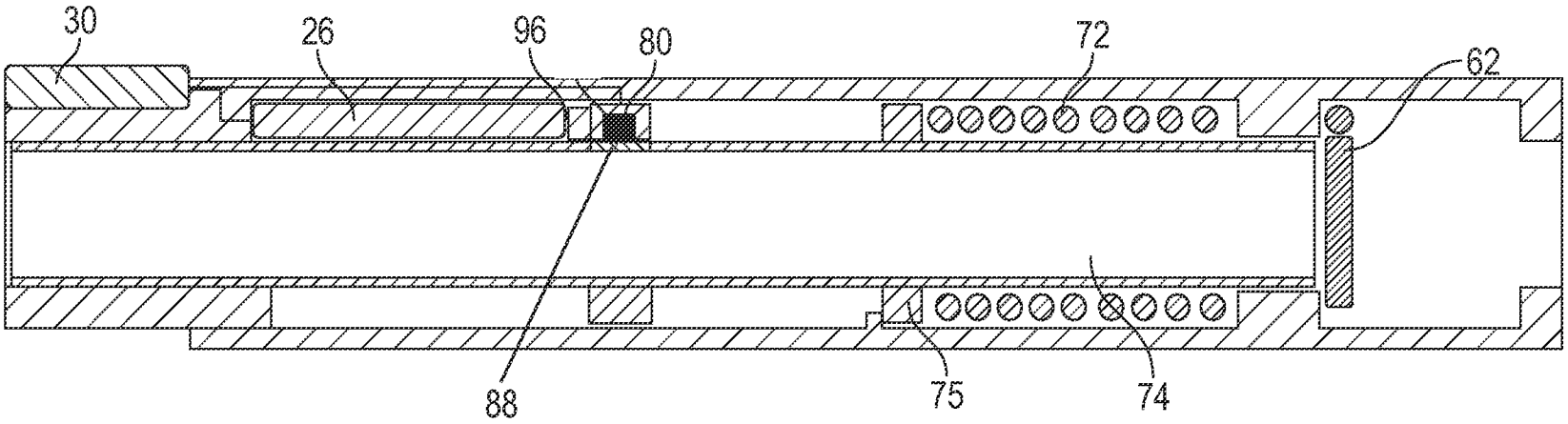
FIGS. 9A-9G schematically illustrate operation of the safety valve of FIG. 8.
Figure 9B:
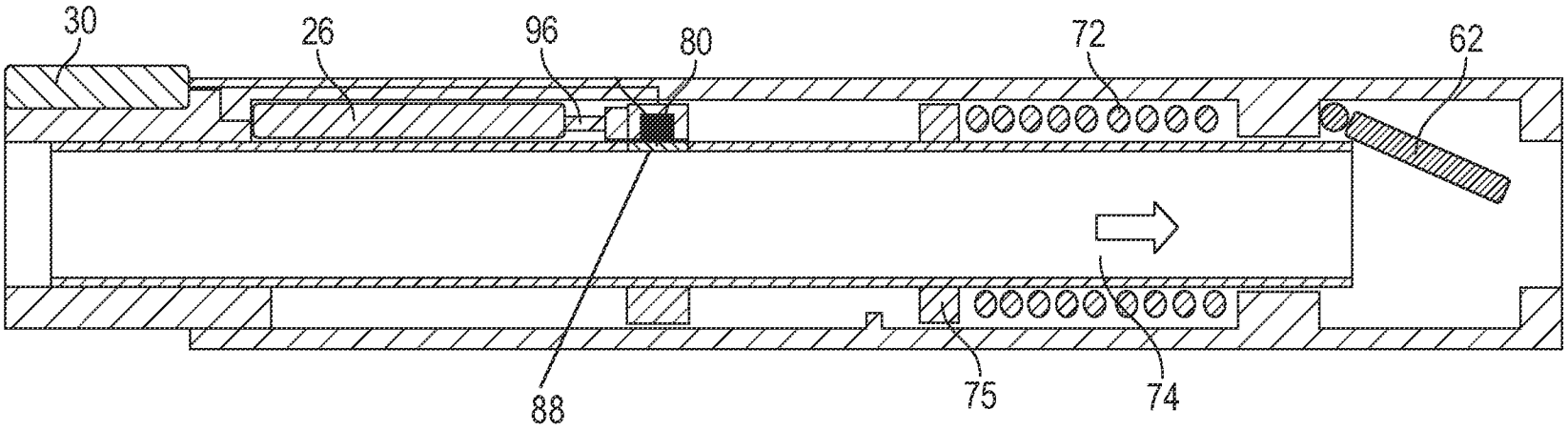
Figure 9C:
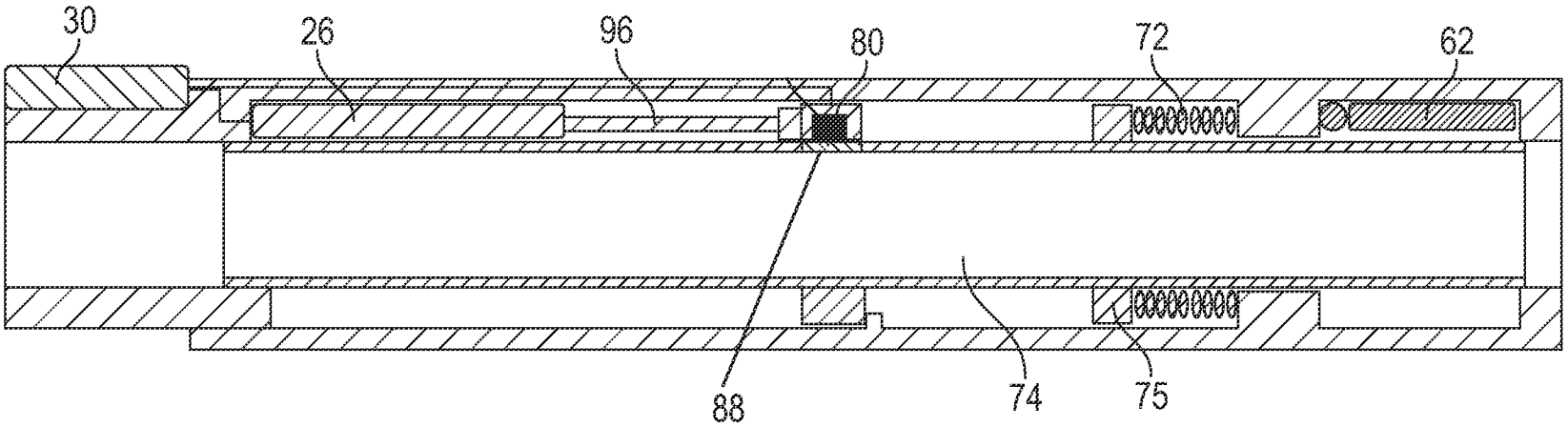

FIGS. 9A-9G schematically illustrate operation of safety valves according to the present disclosure, such as the valve of FIG. 8. FIG. 9A shows the valve in a closed position, with the electro-mechanical actuator (EMA) 26 in a fully retracted position. The E-magnet 80 is activated in order to initiate the coupling between the sleeve 74 and the actuator 26 and prepare the EMA 26 for actuation. FIG. 9B shows the valve opening in response to a command from the surface to the downhole electronics 30. As shown, the E-magnet 80 is activated and the EMA 26 (e.g., the piston or shaft 96) is extending. Extension of the EMA 26 (e.g., the piston or shaft 96) compresses the return spring 72. Extension of the EMA 26 (e.g., piston or shaft 96) moves the internal tubing sleeve 74 toward, into contact with, and/or past the flapper 62 to open the flapper 62. In FIG. 9C, the valve 22 is fully opened, the EMA 26 is in the fully expanded position (and the return spring 72 can be fully compressed and/or the internal tubing sleeve 74 can be shifted to hold open and protect the flapper 62), and the E-magnet 80 is kept activated. Continued activation of the E-magnet 80 can hold the internal tubing sleeve 74 in its shifted position (e.g., the position holding open and protecting the flapper 62, for example as shown in FIG. 9C). If the EMA 26 has enough holding force, the motor can be shut-in. The valve is monitored for EMA back-drive, and if back-drive is detected, the EMA 26 can be powered on and actuated to the proper shaft position.

Figure 9D:
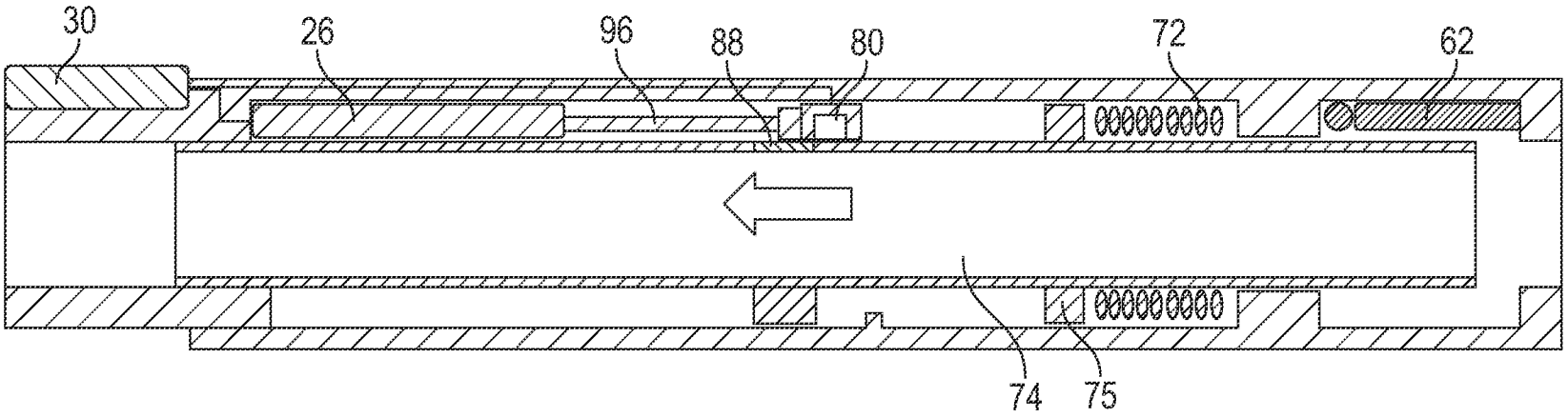
Figure 9E:
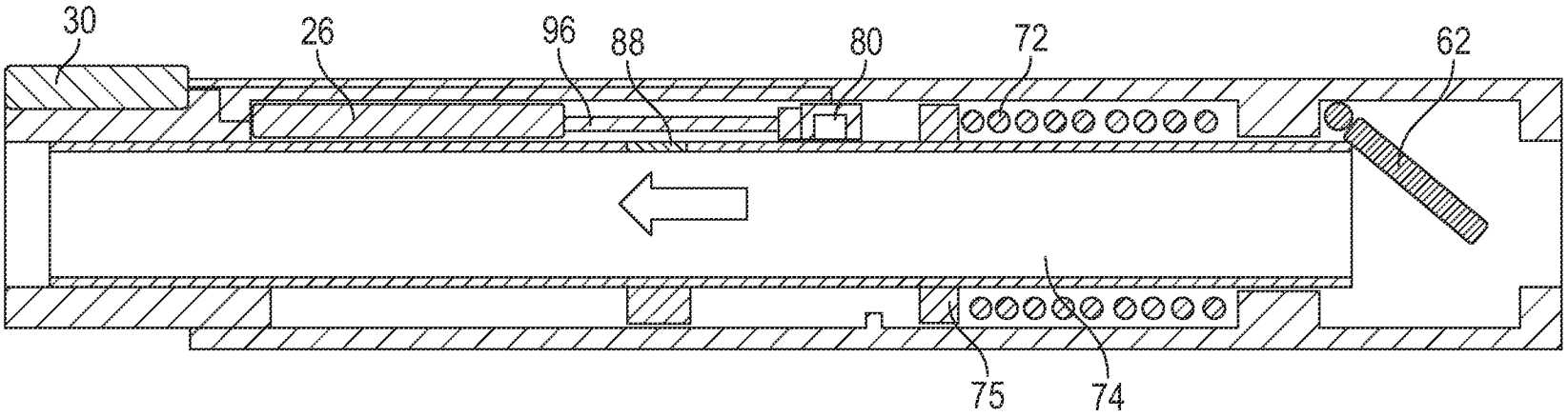
Figure 9F:
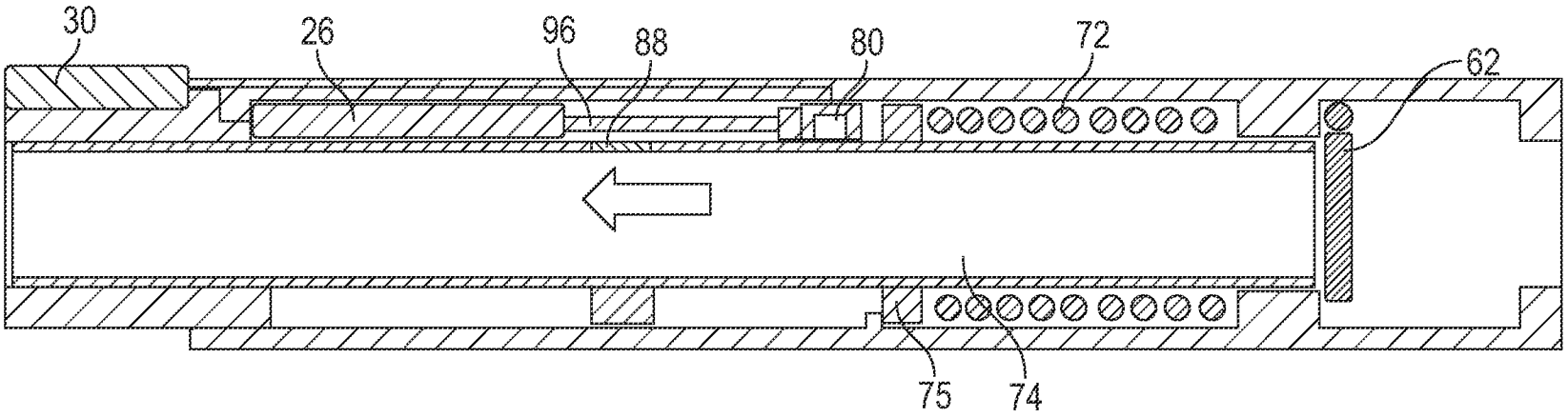
Figure 9G:
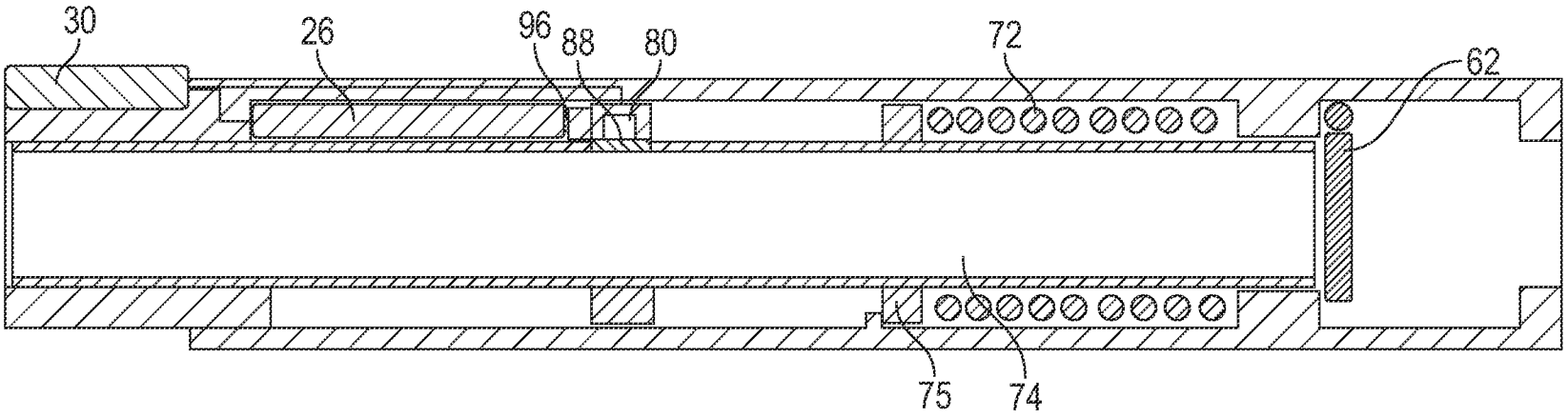

FIGS. 9D-9F show the valve closure mode via de-activation of the e-magnet 80. Closure mode can be triggered intentionally or automatically in the case of electrical shut-down (failsafe mode). De-activation of the E-magnet 80 releases the magnetic coupling with the internal sleeve 74, allowing the return spring 72 to expand and bias the internal sleeve 74 back to its original, closed position, and allowing the flapper 62 to close such that the valve is in a fully closed position or state (FIG. 9F). As the e-magnet 80 is magnetically decoupled from the actuator 26, the slam force is not transmitted to EMA shaft 96. In other words, the internal sleeve 74 can be retracted to its original, closed position without movement of or force on the actuator shaft 96. FIG. 9G shows the valve fully closed with the EMA 26 (e.g., shaft or piston 96) retracted and the e-magnet 80 de-activated. The valve 22 can be re-opened by repeating the process shown in FIGS. 9A-9C.

In some valves according to the present disclosure, there is a magnetic coupling, for example, instead of a fixed mechanical link, between the actuator 26 and the internal tubing sleeve 74, which advantageously prevents or reduces the likelihood of damage to the actuator 26 during a slam closure. In some configurations, the downhole electronics 30 drive the actuator 26 in valve open mode only. In use, the actuator 26 can be set in extension mode to compress the spring 72, then retracted as soon as the e-magnet 80 is activated, thereby ensuring a failsafe operating mode. In use, the e-magnet 80 can be activated as soon as full open mode is reached. In other configurations, the e-magnet 80 is activated prior to extension of the actuator 26 to compress the spring 72. The e-magnet 80 can be released or powered off for valve shut-in to ensure failsafe operating mode. The e-magnet 80 can be strong enough to keep the spring 72 compressed. In some configurations, several magnets can be combined to achieve the desired or required strength. The e-magnet 80 retaining force (e.g., on the internal tubing sleeve 74 and/or spring 72) can be combined with additional mechanical friction if needed to compress the return spring 72. In some configurations, the e-magnet 80 is disposed in a housing mandrel (a non-moving part), which can facilitate connection to the downhole electronics 30. In other configurations, the e-magnet 80 is disposed on the shaft or piston 96 of the actuator 26 (a moving part). In some configurations, valve shut-in is not under control of the EMA 26, but instead advantageously under control of e-magnet 80 power release only. In other configurations, valve shut-in can be under control of both the EMA 26 and the e-magnet 80.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A downhole valve assembly, comprising:

an actuator; and an electric safety valve comprising:

a flapper;

a return spring;

an internal tubing sleeve, wherein the actuator is configured to extend to move the internal tubing sleeve from a closed position to an open position, thereby compressing the return spring and opening the flapper; and an electric magnet, wherein the electric magnet is configured to be activated to hold the internal tubing sleeve in the open position, thereby allowing the actuator to be retracted while the internal tubing sleeve is in the open position.

2. The downhole valve assembly of claim 1, wherein the actuator is an electro hydraulic actuator.

3. The downhole valve assembly of claim 1, wherein the actuator is an electro-mechanical actuator.

4. The downhole valve assembly of claim 3, wherein the downhole valve assembly is fully electric, with no hydraulic components.

5. The downhole valve assembly of claim 1, wherein the actuator is an electro hydraulic pump.

6. The downhole valve assembly of claim 1, the electric safety valve further comprises downhole electronics configured to receive a signal from the surface and control the actuator.

7. The downhole valve assembly of claim 1, wherein closing the flapper is controlled by the electric magnet, and the internal tubing sleeve is moved to the closed position by the return spring by deactivating the electric magnet.

8. The downhole valve assembly of claim 1, wherein the electric magnet is configured to magnetically couple to a corresponding magnet disposed in or on a flange of the internal tubing sleeve, the flange configured to compress the return spring when the internal tubing sleeve moves towards the open position.

9. The downhole valve assembly of claim 8, wherein the flange is disposed between the actuator and the electric magnet in the closed position of the internal tubing sleeve.

10. A method of operating an electric downhole safety valve, the electric downhole safety valve comprising a flapper, an internal tubing sleeve, a return spring, an electric magnet, an actuator, and downhole electronics, the method comprising:

providing a command from the surface to the downhole electronics;

in response to the command from the surface, extending the actuator, thereby shifting the internal tubing sleeve from a closed position to an open position to open the flapper, wherein the return spring is compressed when the internal tubing sleeve is in the open position;

activating the electric magnet;

retracting the actuator while the internal tubing sleeve is held in the open position by the activated electric magnet.

11. The method of claim 10, the actuator comprising an electro-mechanical actuator.

12. The method of claim 10, further comprising deactivating the electric magnet and allowing the return spring to expand, thereby shifting the internal tubing sleeve to the closed position, and allowing the flapper to close.

13. A downhole valve assembly comprising:

a flapper;

an internal tubing sleeve including a flange, wherein the internal tubing sleeve is moveable from a closed position to an open position to open the flapper;

an actuator extendible to move the internal tubing sleeve from the closed position to the open position;

one of a first magnet or a magnetic component disposed in or on the flange;

an electric magnet configured to be activated after the internal tubing sleeve is moved to the open position to interact with the at least one of the first magnet or the magnetic component to hold the internal tubing sleeve in the open position, wherein the flange is disposed between the actuator and the electric magnet when the internal tubing sleeve is in the closed position.

14. The downhole valve assembly of claim 13, wherein the actuator is configured to retract while the internal tubing sleeve is held in the open position by the activated electric magnet.

15. The downhole valve assembly of claim 13, wherein the one of the first magnet or the magnetic component is the first magnet.

16. The downhole valve assembly of claim 13, wherein the actuator is an electro hydraulic actuator.

17. The downhole valve assembly of claim 13, further comprising downhole electronics configured to receive a signal from the surface and control the actuator.

18. The downhole valve assembly of claim 13, further comprising a return spring disposed around the internal tubing sleeve, the return spring including a first end and a second end, wherein the return spring is compressed from an expanded state as the internal tubing sleeve moves towards the open position.

19. The downhole valve assembly of claim 18, wherein the electric magnet is disposed between first end and the second end of the return spring in the expanded state.

20. The downhole valve assembly of claim 18, wherein the return spring expands when the electric magnet is deactivated, thereby moving the internal tubing sleeve to the closed position to close the flapper.

* * * * *